US005337963A

United States Patent [19]

Noakes

[11] Patent Number: 5,337,963

[45] Date of Patent: Aug. 16, 1994

[54] SPRAYING DEVICE

[75] Inventor: Timothy J. Noakes, Clwyd, Wales

[73] Assignee: Imperial Chemical Industries PLC, England

[21] Appl. No.: 788,152

[22] Filed: Nov. 5, 1991

[30] Foreign Application Priority Data

Nov. 12, 1990 [GB] United Kingdom ..... 9024549
May 20, 1991 [GB] United Kingdom ..... 9110885

[51] Int. Cl.[5] ..... B05B 5/16
[52] U.S. Cl. ..... 239/690
[58] Field of Search ..... 239/3, 690, 34, 145

[56] References Cited

U.S. PATENT DOCUMENTS 4,381,533 4/1983 Coffee ..... 239/690
4,476,515 10/1984 Coffee ..... 239/690
4,659,012 4/1987 Coffee ..... 239/690
4,776,515 10/1988 Michalchik .
4,962,885 10/1990 Coffee ..... 239/690

FOREIGN PATENT DOCUMENTS

WO9003224 4/1990 European Pat. Off. .
1069841 1/1953 France .
0312340 3/1956 Switzerland .

*Primary Examiner*—Andres Kashnikow
*Assistant Examiner*—Lesley D. Morris
*Attorney, Agent, or Firm*—Cushman, Darby & Cushman

[57] ABSTRACT

An electrostatic spraying device comprises a housing (10) incorporating a cartridge (16) containing liquid, such as a fragrance-producing oil, which is to be sprayed via a vertically disposed capillary structure (22), electrical potential being applied to the liquid so that the liquid is drawn across the end face of the capillary structure and is sprayed as a plurality of ligaments which break up into droplets.

24 Claims, 3 Drawing Sheets

SPRAYING DEVICE

BACKGROUND OF THE INVENTION

This invention relates to the electrostatic spraying of liquids and is particularly concerned with devices for spraying liquids into the surroundings, for example in situations where the liquid is intended to impart or absorb an aroma or is intended for use in precipitating dust particles or the like from the surroundings.

SUMMARY OF THE INVENTION

According to one aspect of the present invention there is provided a cartridge for storage of liquid suitable for electrostatic spraying, the cartridge comprising a capillary structure extending into the interior of the cartridge to feed liquid by capillary action from the cartridge to a spraying outlet at the tip of the capillary structure, and means for providing an electrically conductive path to allow the application of an electrostatic charge to the liquid, the capillary structure being such that:

when oriented substantially vertically with the spraying outlet disposed upwards, the capillary action is sufficient, independently of the electrostatic forces prevailing in use, to transport liquid upwardly against the action of gravity to the spraying outlet of the capillary structure;

and the spraying outlet comprising:

an innermost peripheral surface bounding the mouth of the spraying outlet, an outermost peripheral surface and an end surface extending laterally between said peripheral surfaces such that, when the liquid at the mouth of the spraying outlet is subjected to at least one potential within the range from 10 kV to 25 kV, a potential gradient is developed between said peripheral surfaces which is sufficient to draw the liquid across said end face towards said outermost peripheral surface whereby, at a position or positions located outwardly of said innermost surface, the liquid is projected electrostatically as an array of ligaments which form a halo around the mouth of the spraying outlet and thereafter break up into droplets.

Thus, in accordance with the invention, instead of the liquid spraying as a single ligament from the mouth itself, the Liquid is caused to spread across said end face so that in is formed into a halo of circumferentially spaced ligaments whereby spraying of smaller diameter ligaments, and hence droplets, is obtained than is possible with a single ligament sprayer.

The capillary structure may be of a conductive material, a semi-conducting material or an insulating material.

In one embodiment of the invention, the spraying outlet of the capillary structure is composed of an insulating material and said end surface is defined by a radial rectilinear or curvilinear generatrix which, at least over a major part of its length, extends predominantly perpendicularly to, rather than parallel with, the axis of the capillary structure. For example, the end surface may be generally planar and perpendicular to the axis of the capillary structure or it may be frusto-conical with an imaginary obtuse angled apex. The end surface, whether defined by a rectilinear or curvilinear generatrix, may be concave or convex. In the case of an insulating spraying outlet, the spraying outlet will have an edge or a sufficiently sharply radiussed formation at or adjacent the location where the end surface and said outermost peripheral surface meet so that, an said potential between 10 and 25 kV, some degree of corona discharge is generated to develop the previously mentioned potential gradient.

In another embodiment of the invention, the spraying outlet is composed of an electrically conducting material and, in this case, it has been found that the end surface should desirably be defined by a curvilinear generatrix such that there is no well-defined edge or formation at which substantial corona discharge can occur. For example, the end surface in this case may be convexly curvilinear and may merge smoothly with at least the outermost peripheral surface and preferably with the innermost peripheral surface also.

According to a second aspect of the present invention there is provided a cartridge for storage of liquid suitable for electrostatic spraying, the cartridge comprising a bottom wall formed with a recess, a capillary structure extending into the interior of the cartridge with one end of the capillary structure received in said recess so as to feed liquid by capillary action from the recess to a spraying outlet at the tip of the capillary structure, and means for providing an electrically conductive path to allow the application of an electrostatic charge directly to the portion of liquid accommodated within the recess.

According to a further aspect of the present invention there is provided an electrostatic spraying device comprising a cartridge as defined according to said first or second aspects of the invention, a housing into which the cartridge can be removably inserted, the housing being adapted for use in a predetermined orientation and, when so oriented, being arranged to locate the cartridge with the capillary structure extending generally vertically upwards, and high voltage means located within the housing exteriorly of the cartridge for applying electrostatic potential to said means providing an electrically conductive path to the liquid within the cartridge.

A feature of the invention is that the spraying outlet is arranged to spray generally vertically upwards without requiring a positive head, i.e. it is not necessary for the spraying outlet to be located at a lower level than the liquid level within the cartridge.

The housing may be adapted to be placed on a horizontal surface in which case it may have a flat base or have formations for contact with a horizontal surface so that the housing is orientated in such a way that, with the cartridge inserted therein, the capillary structure is located generally vertically with its spraying outlet uppermost. Alternatively, or additionally, the housing may be intended to be suspended from a generally vertical surface such as a wall in which case it will be provided with a suspension means so arranged that the housing will be appropriately oriented in use. For example, the housing may include a wall contacting surface which, in conjunction with the suspension means, ensures that the capillary structure is appropriately oriented when the housing is mounted on the wall.

Typically, suitable liquids to be sprayed will have a bulk resistivity of the order of $10^4$ to 1 to $2\times10^8$ Ω cm, the latter limit being usable when the capillary structure is of a conductive material.

The cartridge conveniently has a squat configuration with a vertical dimension somewhat less than its horizontal dimensions so that it can contain a significant amount of liquid while producing a small change in liquid level between its full and near-empty conditions.

Preferably the cartridge is so designed that the difference in liquid level between the full and near-empty conditions of the cartridge does not change by more than 15 mm and typically the change will be no more than about 10 mm.

The capillary structure in general will be composed of a material with respect to which the liquid to be sprayed exhibits good capillary rise and will comprise at least one capillary passage, the dimensions of the passage(s) and the material of capillary structure being selected to effect transport of the liquid as aforesaid.

The capillary structure is conveniently in the form of a capillary tube, e.g. a metal, glass or plastics tube, or it may be in the form of an annular passage defined between a pair of generally concentric surfaces, e.g. a pair of metal, glass or plastics tubes.

In an alternative embodiment the capillary structure may comprise a mass of fibers forming a wick structure. The fiber forming the wick structure may be packed tightly into a tube, the tip of which will form the spraying outlet of the capillary structure.

Where the capillary structure is constituted by a tube of insulating material, at the end constituting the spraying tip the tube may be cleanly cut substantially at right angles to the axis of the tube and the wall thickness of the tube at the tip should be selected so that the radial distance between the meniscus of the liquid in the tube and the outer peripheral edge of the tube is short whereby a steep potential gradient is produced across the wall thickness, this being important to ensure that the liquid is drawn from the meniscus across the end surface at the tip and towards the peripheral edge of the tip from where the liquid issues. A potential gradient is believed to exist between these points in operation because of the tendency for corona to occur at the outer peripheral edge which results in a lower potential at this point compared with the potential existing at the liquid meniscus. Typically the wall thickness of the tube at the tip is no greater than 1 mm, and preferably no greater than about 500–600 microns. In accordance with said one aspect of the invention, small droplet sizes can be achieved if the liquid emerging at the tip is sprayed as a plurality of jets or ligaments in the case where the capillary structure is in the form of a tube of insulating material, this can be achieved by selecting the wall thickness of the tube at the tip such that the potential gradient at the outer peripheral edge of the tube is sufficient to secure multi-jet spraying as opposed to single jet spraying when the nearest earthed object or structure is relatively remote from the tip.

Where the capillary structure is in the form of a metal tube, the outer peripheral edge of the tube at its tip should not be sharp otherwise substantial corona discharge will occur. Preferably, the tube at least at its tip is radiussed in the manner of a cannula syringe needle. The wall thickness of the conducting capillary tube is typically no greater than 1 mm, more preferably no greater than about 500–600 microns.

The capillary structure should desirably extend upwardly from a position at or near the bottom of the cartridge in order that substantially the entire liquid content of the cartridge can be emptied from the cartridge by electrostatic spraying.

The means providing said electrically conductive path is preferably arranged to provide an electrical connection between the high voltage means and a location within the interior of the cartridge so that electrostatic potential is applied to the tip of the capillary structure through the agency of the liquid.

Where the cartridge is composed of an electrically insulating material, such electrically conducting means may be constituted by an electrical contact extending through a wall, preferably the base, of the cartridge.

Alternatively, the cartridge may be composed at least in part of a material which is sufficiently conductive to provide the conducting path between the interior and the exterior of the cartridge. For example, the cartridge may have at least one wall at least a portion of which is composed of material which is sufficiently electrically conductive to provide electrical continuity between the high voltage means and liquid contained in the cartridge. By sufficiently electrically conductive, we do not exclude the possibility of the use of materials, i.e. semi-conducting materials which have bulk resistivities intermediate good conductors and good insulators, i.e. in the range from $10^6$ to $10^{13}$ Ω cm, such materials being usable if good electrical contact is made between the cartridge and the high voltage means.

The conductive portion of the cartridge is conveniently so located that, when the cartridge is inserted into the housing, said portion automatically registers with a terminal of the high voltage means. A high resistance element may be included in the circuitry of the high voltage means between the high voltage output and said terminal in order to provide shock suppression in the event of the tip of the capillary structure or said terminal being touched.

In one embodiment of the invention, the housing comprises a recess in which the cartridge is received and the arrangement may be such that the high voltage means includes a terminal which, on insertion of the cartridge into said recess, registers with the means providing said conductive path.

The high voltage means may include a user-operable switch for selectively connecting and disconnecting the high voltage means from the cartridge so that spraying can be discontinued when desired.

The circuitry of the high voltage means may include switch means operable to disable the high voltage means when the cartridge is removed from the housing. Thus, in said one embodiment of the invention, the switching action of the disabling switch means may be controlled by an actuator located adjacent the recess for co-operation with the cartridge such that, on insertion of the cartridge into the recess, the disabling switch allows normal operation of the high voltage means (e.g. under the control of the user-operable switch if provided) whereas removal of the cartridge from the recess results in operation of the actuator which causes disabling of the high voltage means.

The device may be operated so as to produce a spray in which the initially electrostatically charged particles remain charged with the advantage that the particles then tend to be widely dispersed into the surroundings by attraction to remote earthed objects and structures, e.g., the walls, ceiling and floor of a room. In this instance, the electrostatic potential applied to the liquid may be uni-polar or it may alternate between positive and negative polarities whereby particles are sprayed in successive clouds of opposite polarity, the frequency of alternation being such that successive clouds of particles do not discharge one another to any substantial extent while they are airborne. For example, the frequency may be of the order of 10 Hz or less, typically 5 Hz or less.

Alternatively, the device may be operated to produce a spray in which the initially charged particles are discharged shortly after being projected from the device. This may be achieved by applying an alternating electrostatic potential to the liquid whereby particles are sprayed in successive clouds of opposite polarity, the frequency of the alternating potential being such that successive clouds of particles substantially discharge one another while airborne. For example, the frequency of the alternating potential may be of the order of tens of Hertz, typically at least 30 Hz. By discharging the spray, the particles are less prone to being drawn to the nearest earthed object or structure, which will often be the surface on which the housing is supported. In the case of charged particles, there will be a tendency for a proportion of the particles to deposit on the supporting surface in an annular zone immediately around the housing. This tendency is considerably reduced by arranging for the discharge of the particles shortly after they become airborne.

Advantageously, where the device is operated with a uni-polar voltage source rather than an alternating voltage, the device includes means for providing electrical continuity, in use, between the housing and a surface with which it makes contact in use so as to provide an earth return path for the high voltage means. Such electrical continuity may be achieved by making the housing, at least in part, from a conductive material. Alternatively, the housing may incorporate a conductive part which is arranged to contact a surface on which the housing is supported in use.

The housing conveniently comprises an interior configuration such that correct insertion of the cartridge therein is only possible when the cartridge is in one particular orientation. Access to the housing inferior is conveniently afforded via an opening closed by a removable cover which includes an aperture through which, in use, the capillary structure either projects or is arranged to spray.

The cover will often comprise an electrically insulating or semi-insulating material and serves to shield the tip of the capillary structure from the high potential existing at the liquid surface within the cartridge. The cover, in particular its design and/or selection of materials, may have some influence on the spraying mechanism since, in some circumstances, the presence of the cover has been found to deleteriously affect spraying or suppress it altogether.

Accordingly, in accordance with another aspect of the invention there is provided an electrostatic spraying device comprising a cartridge for storage of liquid suitable for electrostatic spraying, the cartridge including a capillary structure extending into the interior of the cartridge so as to feed liquid by capillary action from the cartridge to a spraying outlet at the tip of the capillary structure, a housing into which the cartridge can be removably inserted, the housing being adapted for use in a predetermined orientation and, when so oriented, being arranged to locate the cartridge with the capillary structure extending generally vertically upwards, and high voltage means located within the housing exteriorly of the cartridge for applying electrostatic potential to the liquid within the cartridge, the housing including a cover having an aperture through which the tip of the capillary structure projects or is arranged to spray and the cover comprising at least in a region surrounding said aperture a hydrophobic electrically insulating material.

Preferably the cover is composed at lease in part of a hydrophobic polymeric material such as polypropylene or polythene. The use of a hydrophobic material serves to limit the extent to which electrical charge can build up on the cover as a result of spray droplets falling back on to the cover or other means (for example, corona discharges) of charge deposition on the cover. In the case of a cover of hydrophobic material, deposited electrical charge tends to be immobile and thereby rapidly builds up to a level such that further deposition is repelled. In contrast, with a cover of hydrophilic material, the charge tends to be mobile thus allowing greater quantities of charge to deposit with consequent general build up of potential on the cover, which result in spraying being suppressed altogether.

According to yet another aspect of the invention there is provided an electrostatic spraying device comprising a cartridge for storage of liquid suitable for electrostatic spraying, the cartridge including a capillary structure extending into the interior of the cartridge so as to feed liquid by capillary action from the cartridge to a spraying outlet at the tip of the capillary structure, a housing into which the cartridge can be removably inserted, the housing being adapted for use in a predetermined orientation and, when so oriented, being arranged to locate the cartridge with the capillary structure extending generally vertically upwards, and high voltage means located within the housing exteriorly of the cartridge for applying electrostatic potential to the liquid within the cartridge, the housing including a cover having an aperture through which the tip of the capillary structure projects or is arranged to spray and the cover comprising at least in the region surrounding said aperture a semi-insulating material and means located beneath the external surface of the cover for providing an electrically conductive path for transporting electrical charge away from the cover.

In this instance, electrical charge build up on the cover is limited by leaking deposited charge away from the cover.

Typically the semi-insulating material will have a bulk resistivity within the range from $10^{10}$ to $10^{13}$ ohm cm; for example the cover may be composed at least in part of melamine, soda glass, or suitable ceramic materials or phenol formaldehyde composites.

The means for leaking charge away from the cover may be embedded within the material of the cover and make take the form of an electrode which, in use, is earthed, for example via contact between the housing and a surface on, or against, which the housing is supported.

BRIEF DESCRIPTION OF THE DRAWINGS

The invention will now be described by way of example with reference to the accompanying drawings, in which.

DETAILED DESCRIPTION OF THE PRESENTLY PREFERRED EXEMPLARY EMBODIMENTS

Figure 1:
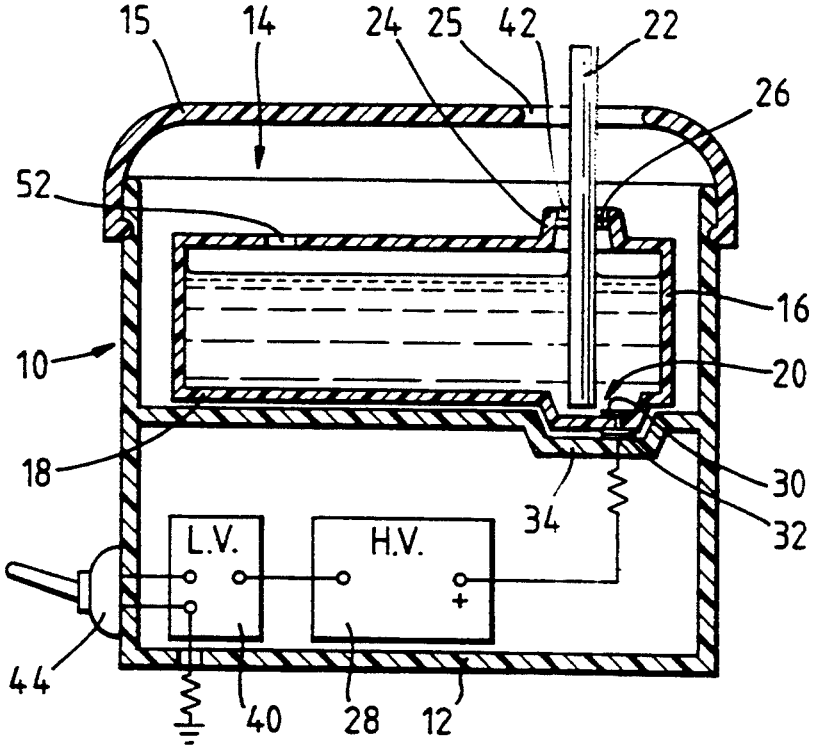
FIG. 1 is a schematic view of an electrostatic air freshener device in accordance with the invention.

Referring to the drawings, the air freshener device comprises a housing 10, the bottom wall 12 of which is intended in use to be supported on a generally horizontal surface such as a table top, a shelf or the like. The housing 10 is provided with a compartment 14 to which access can be gained by removal of cover 15 so that a cartridge 16 containing the liquid to be sprayed can inserted into the compartment. The liquid is one suitable for electrostatic spraying and is be selected to have the characteristics appropriate for the intended use of the device, i.e. in this case, the liquid will have aromatic properties. The cartridge 16 is of squat parallelepiped configuration, its smallest dimension being in the vertical direction such that the vertical distance between its bottom wall 18 and the liquid level when the cartridge is full is about 15 mm or less (more preferably about 10 mm or less). The bottom wall of the cartridge has a recess 20 therein which acts as a sump.

A capillary tube 22 is mounted within the cartridge so as to be generally vertical (i.e. generally perpendicular to the horizontal bottom wall 18) and its lower end is received within the recess 20 to allow liquid supply to the tube 22 to be maintained as the liquid level approaches the bottom wall 18. The upper end of the capillary tube 22 projects through an opening defined by upstanding collar 24 and through an aperture 25 in the cover 15, detent means 26 being provided to locate the tube 22 centrally within the collar 24. Although, in FIG. 1, the tube 22 and the recess 20 are shown positioned at one side of the cartridge, they may be positioned elsewhere, for example, at or adjacent the center of the cartridge (e.g. as shown in FIG. 2).

Figure 2:
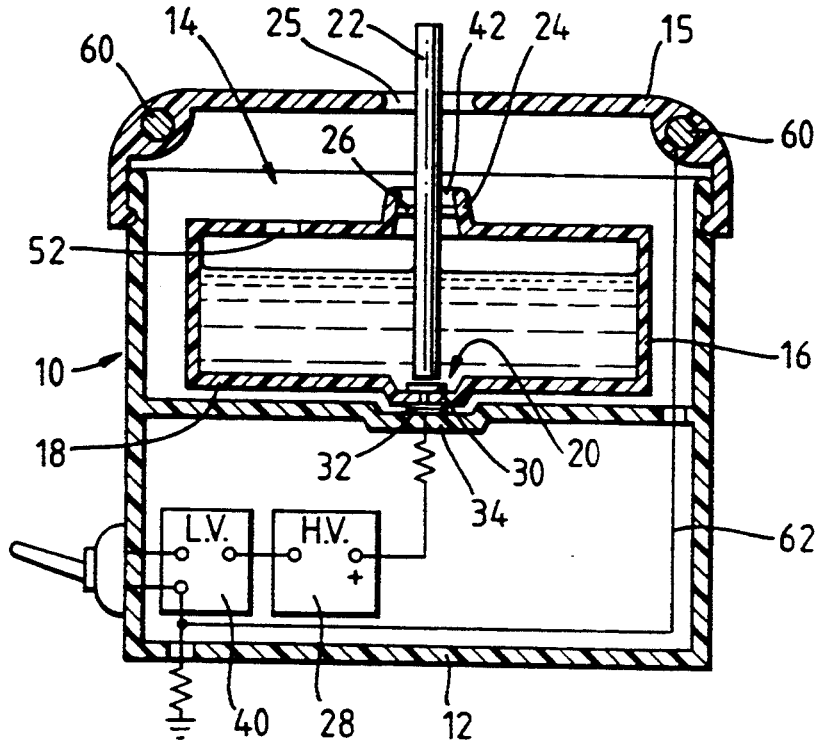
FIG. 2 is a schematic view of a cartridge for use with the device.

The cartridge 16 is adapted to provide for the connection of the liquid therein to the high voltage output of a high tension generator 28 (see FIG. 1). This may be achieved in various ways as previously discussed; in the illustrated embodiment, the cartridge is formed from an electrically insulating material and is provided with an electrical contact 30. The contact 30 is located at the base of the recess 20 so that, when the cartridge is correctly inserted into the compartment 14, the contact 30 registers with a terminal 32 connected to the high voltage output of the generator 28. The generally horizontal bottom wall of the compartment 14 in the housing includes a depression 34 for reception of the recess 20 of the cartridge so that when the cartridge is in place, the bottom wall 18 of the cartridge is generally parallel with the bottom wall 12. The compartment 14 and the depression may be so dimensioned and arranged that the cartridge can only make operative contact with the terminal 32 if inserted correctly in the housing.

The low voltage side of the generator 28 is connected to a low voltage circuit 40 including one or more batteries (typically 9 volts) and can be switched on or off by means of a user operable switch 44. The generator 28 produces a low current, high voltage output which is typically of the order of 10 to 25 kV and in use this voltage is applied to the liquid contents of the cartridge 16 to effect electrostatic spraying of the liquid from the tube 22. The low voltage circuit 40 may be arranged to control the generator and thereby control spraying according to requirements. The low voltage circuit has a connection to earth through the bottom wall 12 of the housing.

The capillary tube 22 is adapted to provide sufficient capillary rise when disposed vertically to feed liquid from the cartridge to its uppermost tip irrespective of the liquid level within the cartridge. This can be achieved by suitable dimensioning of the capillary tube and selection of the material from which it is fabricated. The tube 22 in general will have a narrow bore and a relatively thin wall. Where the tube 22 is of an insulating material the atomising end thereof is preferably cleanly cut with an end face perpendicular to the axis of the tube. In the case where the tube is of a conducting material, sharp edges are not desirable since they tend to give rise to excessive corona discharges; such tubes are therefore preferably radiussed at the tip. One suitable form of radiussed tip tube is a metal cannula syringe needle, e.g. 25 gauge.

The tube 22 may have an inside diameter of up to 300 to 400 microns, inside diameters of the order of 100 to 250 microns being preferred, and an outside diameter of the order of 0.5 to 0.75 mm, and the tube may be of a length such that it projects from the cartridge by about 1 to 5 mm. Suitable materials include plastics materials such as nylon and polythene provided that tubes formed from these materials are dimensioned to provide sufficient capillary rise. In the case of nylon tubes used in conjunction with an ethanol based liquid having a resistivity of $2.5\times10^6$ ohm cm and a viscosity of 1.52 centistokes, satisfactory multi-jet spraying has been achieved with a capillary bore of 0.3 mm, a wall thickness of 0.3 mm and a capillary length of 25 mm, using an applied voltage of the order of 20 kV.

An annular gap 42 is defined between the tube 22 and the collar 24 to allow the ingress of air as the liquid is discharged from the cartridge. The gap 42 is dimensioned so that, when the cartridge is inverted or otherwise oriented in a position in which the liquid could otherwise drain from the cartridge via the gap 42, the gap 42 traps and holds the liquid by surface tension forces. For example, the inside diameter of the collar 24 may be of the order of 1 to 1.5 mm compared with an outside diameter of the order of 0.5 to 0.75 mm for the tube 22. The cartridge is conveniently provided with a sealing cap (not shown) which can be fitted over the tube tip and engage the collar, e.g. with a screw-threaded or snap fit engagement, to seal the tube opening and the annular gap when the cartridge is not in use.

Instead of allowing air ingress via the a gap 42 as described above, the capillary tube may have a substantially sealed fit within the collar 24 and a separate air ingress port 52 may be provided. This port may be fitted with a plug (not shown) to prevent leakage, the plug being removed by the user, for example after or during insertion of the cartridge into the housing 10.

In use, the liquid is fed solely by the capillary action of the tube to the uppermost tip of the tube where it is caused to atomise by the high voltage applied to the liquid, the atomised particles being electrically charged whereby they are drawn away from the tube tip towards objects and structure in the surroundings which are at earth potential. Typically, the device will be used in a room and the walls, ceiling and floor will therefore provide relatively remote targets towards which the particles are drawn.

In the embodiment of FIG. 1, the cover 15 is fabricated from a hydrophobic electrically insulating plastics material such as polypropylene or polythene so that electrical charge accumulating on the cover, as a result of charged droplets falling onto the cover, is substantially immobile thereby limiting the extent to which the cover may charge up and hence avoiding suppression of spraying. FIG. 2 illustrates a generally similar embodiment to that of FIG. 1 and the same reference numerals are used to depict like components. In the case of FIG. 2, a different mechanism is employed to prevent build up of electrical charge on the cover: thus, the cover in this case is fabricated from a semi-insulating material (typically having a bulk resistivity in the range from $10^{10}$ to $10^{13}$ ohm cm) and an electrode 60 is embedded within the cover 15 and is connected to a low potential such as earth for example via a lead 62 so that electrical charge accumulating on the cover is leaked away thereby preventing build up of a spray suppressing potential on the cover. Although the electrode 60 is shown as being associated with the cover 15, it may be associated with the housing 10 and arranged so as to contact the cover 15 when the latter is in position on the housing 10. In both embodiments, the housing 10 may be composed of insulating or semi-insulating material (e.g. having a bulk resistivity of at least $10^{10}$ ohm cm. Where it is of semi-insulating material, the housing will be suitably adapted to ensure that the contact 32 and associated circuitry is electrically isolated from the housing. For instance, the support on which the cartridge is seated may be of insulating material.

Figure 3:
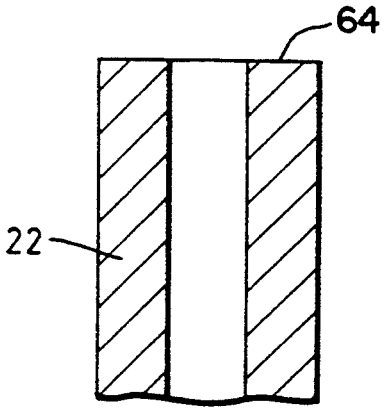
FIGS. 3, 4, 5 and 6 show, schematically, different forms of capillary tube tip; and FIGS. *7a* and *7b* show liquid being projected as an array of ligaments forming a halo around the spraying outlet.
Figure 4:
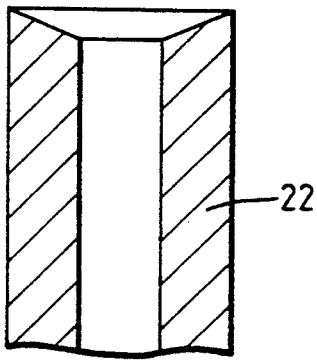
Figure 5:
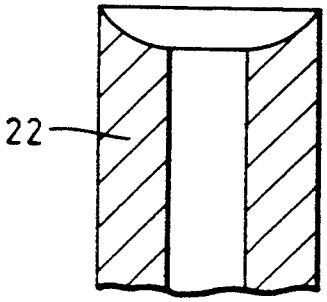
Figure 6:
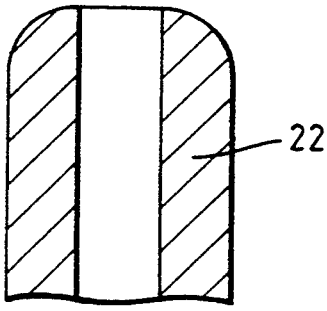
Figure 7A:
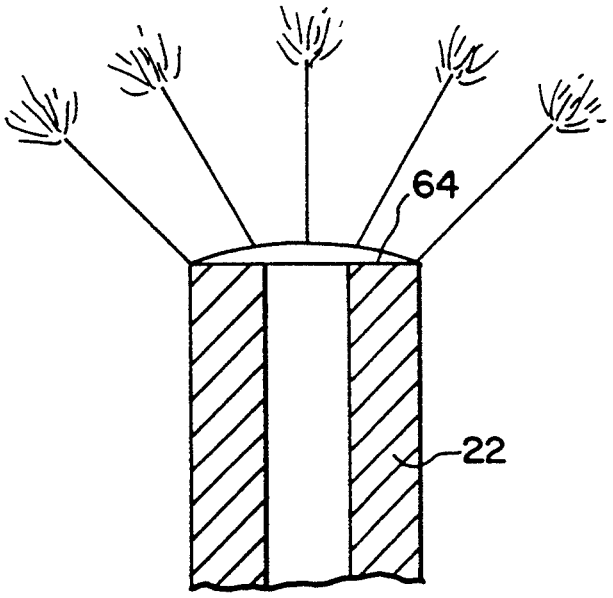
Figure 7B:
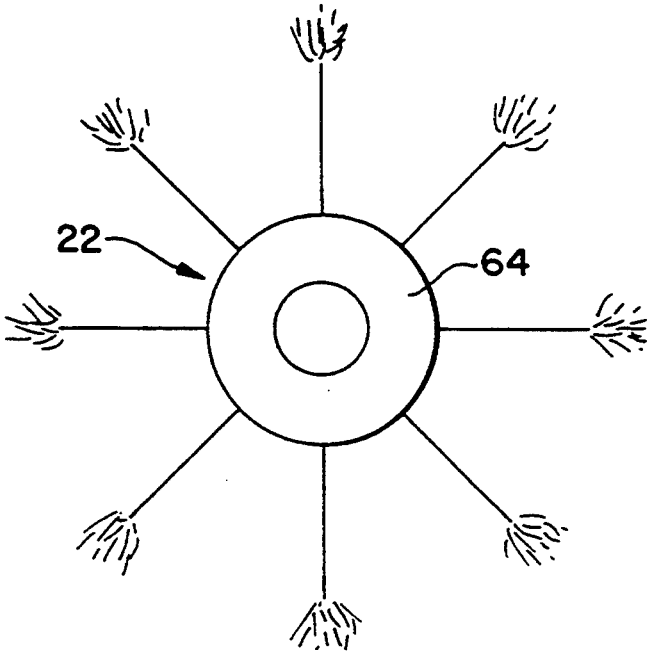

FIG. 3 illustrates a suitable configuration for the tip of an insulating capillary tube 22. The end face 64 of the tube is cleanly cut at right angles to the tube axis. To a limited extent, corona discharge will occur from the outer peripheral edge of the end face 64 with consequent dropping of potential across the radial dimension of the end face. If the end face is thin in the radial direction, the potential gradient developed for an applied voltage within the range of 10 to 25 kV can be made sufficiently intense to draw the liquid emerging at the mouth of the tube 22 across the end face and towards the outer edge where multi-ligament or jet spraying occurs, the ligaments being distributed substantially equi-angularly around the outer edge of the tube 22. Multi-ligament spraying affords the advantage of creating smaller size droplets than are attainable with single ligament spraying from the tube. It is to be understood that the tube tip configuration need not be limited to that shown in FIG. 3 in order to secure multi-ligament spraying. The same effect can be obtained for insulating tubes if the end face is other than perpendicular to tube axis, i.e. as shown in FIG. 4. Also, the end face need not be one which is generated by a rectilinear radial generatrix, i.e. the generatrix could be curvilinear as shown in FIG. 5.

Where the tube 22 is of a conducting material, the end face of the tube should be such as to avoid well-defined features or formations from which substantial corona discharge could occur. Multi-ligament spraying has been achieved with a configuration such as that shown in FIG. 6 where the end face will be seen to be radiussed and merge smoothly with the outer peripheral surface of the tube 22.

In a modified embodiment, the circuitry producing the high voltage applied to the liquid may be designed to produce an alternating output as previously described herein, the alternating frequency being such that successive clouds of sprayed particles of opposite polarity either retain their charge while airborne or discharge one another soon after issuing from the tip of tube 22. The latter modification has the advantage that the discharged particles are free to disperse in the surroundings without being influenced by earthed objects, such as the surface supporting the housing.

Where it is desired to produce spray particles which remain charged while air-borne, the use of an alternating potential to charge the liquid particles in such a way that successive clouds of particles retain their charge while airborne is advantageous in situations where the housing is supported on a highly insulating surface. In such a situation, if a uni-directional potential is applied to the liquid, the bottom of the housing (being insulated from earth by the supporting surface) would tend to become charged with a polarity opposite to that of the particles with the drawback that the housing would then produce a strong attractive force causing a substantial proportion of the particles to deposit around the bottom of the housing. The use of an alternating potential avoids this problem since build up of a potential of opposite polarity is not then possible.

In order to suppress shocks, which in any event would be of low energy, the low voltage side of the generator will include a high resistance so as to suppress shock when the housing is touched. When the cartridge is in place in the compartment 14 and is connected to the high voltage output of the generator 28, the fact that the voltage is applied through the liquid column in the narrow bore of tube 22 will provide a high resistance path (and hence suppression of shock that would otherwise be experienced by touching the tip of the tube 22) by virtue of the resistivity of the liquid and the cross-section and length dimensions of the tube bore. However, the resistance provided by the liquid may be supplemented if desired by the inclusion of a high resistance on the high voltage side of the generator, e.g. between the generator high voltage output and the terminal 32.

I claim:

1. A cartridge for storage of liquid suitable for electrostatic spraying, the cartridge comprising a capillary structure extending into the interior of the cartridge to feed liquid by capillary action from the cartridge to a spraying outlet at the tip of the capillary structure, and means for providing an electrically conductive path to allow the application of an electrostatic charge to the liquid, the capillary structure being such that:

when oriented substantially vertically with the spraying outlet disposed upwards, the capillary action is sufficient, independently of the electrostatic forces prevailing in use, to transport liquid upwardly against the action of gravity to the spraying outlet of the capillary structure;

and the spraying outlet comprising:

an innermost peripheral surface bounding a mouth of the spraying outlet, an outermost peripheral surface and an end surface extending laterally between said peripheral surfaces such that, when the liquid at the mouth of the spraying outlet is subjected to at least one potential within the range from 10 kV to 25 kV, a potential gradient is developed between said peripheral surfaces which is sufficient to draw the liquid across said end face towards said outermost peripheral surface whereby, at a position or positions located outwardly of said innermost surface, the liquid is projected electrostatically as an array of ligaments which form a halo around the mouth of the spraying outlet and thereafter break into droplets;

the end surface being of frusto-conical configuration, being defined by a radial rectilinear or curvilinear generatrix which, at least over a major part of its length, extends predominantly perpendicularly to, rather than parallel with, an axis of elongation of the capillary structure.

2. A cartridge for storage of liquid suitable for electrostatic spraying, the cartridge comprising a capillary structure of an electrically conductive material which extends into the interior of the cartridge to feed liquid by capillary action from the cartridge to a spraying outlet at the tip of the capillary structure, and means for providing an electrically conductive path to allow the application of an electrostatic charge to the liquid, the capillary structure being such that:

when oriented substantially vertically with the spraying outlet disposed upwards, the capillary action is sufficient, independently of the electrostatic forces prevailing in use, to transport liquid upwardly against the action of gravity to the spraying outlet of the capillary structure;

and the spraying outlet comprising:

an innermost peripheral surface bounding a mouth of the spraying outlet, an outermost peripheral surface and an end surface extending laterally between said peripheral surfaces such that, when the liquid at the mouth of the spraying outlet is subjected to at least one potential within the range from 10 kV to 25 kV, a potential gradient is developed between said peripheral surfaces which is sufficient to draw the liquid across said end face towards said outermost peripheral surface whereby, at a position or positions located outwardly of said innermost surface, the liquid is projected electrostatically as an array of ligaments which form a halo around the mouth of the spraying outlet and thereafter break up into droplets;

the end surface being defined by a curvilinear generatrix such that there is no well defined edge or formation at which substantial corona discharge can occur.

3. A cartridge for storage of liquid suitable for electrostatic spraying, the cartridge comprising a bottom wall formed with a recess, a capillary structure extending into the interior of the cartridge with one end of the capillary structure received in said recess so as to feed liquid by capillary action from the recess to a spraying outlet at the tip of the capillary structure, and means for providing an electrically conductive path to allow application of an electrostatic charge directly to a portion of liquid accommodated within the recess.

4. A cartridge as claimed in claim 3 wherein the capillary structure is such that:

when oriented substantially vertically with the spraying outlet disposed upwards, the capillary action is sufficient; independently of the electrostatic forces prevailing in use, to transport liquid upwardly against the action of gravity to the spraying outlet of the capillary structure;

and the spraying outlet comprising:

an innermost peripheral surface bounding a mouth of the spraying outlet, an outermost peripheral surface and an end surface extending laterally between said peripheral surfaces such that, when the liquid at the mouth of the spraying outlet is subjected to at least one potential within the range from 10 kV to 25 kV, a potential gradient is developed between said peripheral surfaces which is sufficient to draw the liquid across said end face towards said outermost peripheral surface whereby, at a position or positions located outwardly of said innermost surface the liquid is projected electrostatically as an array of ligaments which form a halo around the mouth of the spraying outlet and thereafter break up into droplets.

5. A cartridge as claimed in any one of claims 1 or 4 having a squat configuration with a vertical dimension somewhat less than its horizontal dimensions.

6. A cartridge as claimed in claim 5 in which the cartridge is so designed that the difference in liquid level between the full and near-empty conditions of the cartridge does not change by more than 15 mm.

7. A cartridge as claimed in any one of claims 2–4 in which the capillary structure is in the form of a tube.

8. A cartridge as claimed in any one of claims 1 or 2–4 in which the capillary structure comprises a mass of fibers forming a wick.

9. A cartridge as claimed in any one of claims 1 or 2–4 in which capillary structure is in the form of a tube having a wall thickness no greater than 1 mm.

10. A cartridge as claimed in any one of claims 1 or 2–4 in which the cartridge is composed of an electrically insulating material and said electrically conductive path is constituted by an electrical contact extending through a wall of the cartridge.

11. A cartridge as claimed in any one of claims 1 or 2–4 in which the cartridge is composed at least in part of a material which is sufficiently conductive to provide the conducting path between the interior and the exterior of the cartridge.

12. An electrostatic spraying device comprising a cartridge as claimed in any one of claims 1 or 2–4, a housing into which the cartridge can be removably inserted, the housing being adapted for use in a predetermined orientation and, when so oriented, being arranged to locate the cartridge with the capillary structure extending generally vertically upwards, and high voltage means located within the housing exteriorly of the cartridge for applying electrostatic potential to said means providing an electrically conductive path to the liquid within the cartridge.

13. A device as claimed in claim 12 in which the high voltage means is bi-polar whereby successive clouds of sprayed particles are of opposite polarity.

14. An electrostatic spraying device comprising a cartridge for storage of liquid suitable for electrostatic spraying, the cartridge including a capillary structure extending into the interior of the cartridge so as to feed liquid by capillary action from the cartridge to a spraying outlet at a tip of the capillary structure, a housing into which the cartridge can be removably inserted, the housing being adapted for use in a predetermined orientation and, when so oriented, being arranged to locate the cartridge with the capillary structure extending generally vertically upwards, and high voltage means located within the housing exteriorly of the cartridge for applying electrostatic potential to the liquid within the cartridge, the housing including a cover having an aperture through which the tip of the capillary structure projects or is arranged to spray and the cover comprising at least in a region surrounding said aperture a hydrophobic electrically insulating material.

15. A device as claimed in claim 14 in which the cartridge includes means for providing an electrically conductive path to allow the application of an electrostatic charge to the liquid, the capillary structure being such that:

when oriented substantially vertically with the spraying outlet disposed upwards, the capillary action is sufficient; independently of the electrostatic forces prevailing in use, to transport liquid upwardly against the action of gravity to the spraying outlet of the capillary structure;

and the spraying outlet comprising:

an innermost peripheral surface bounding a mouth of the spraying outlet, an outermost peripheral surface and an end surface extending laterally between said peripheral surfaces such that, when the liquid at the mouth of the spraying outlet is subjected to at least one potential within the range from 10 kV to 25 kV, a potential gradient is developed between said peripheral surfaces which is sufficient to draw the liquid across said end face towards said outermost peripheral surface whereby, at a position or positions located outwardly of said innermost surfaces, the liquid is projected electrostatically as an array of ligaments which form a halo around the mouth of the spraying outlet and thereafter break up into droplets.

16. An electrostatic spraying device comprising a cartridge for storage of liquid suitable for electrostatic spraying, the cartridge including a capillary structure extending into the interior of the cartridge to a spraying outlet at a tip of the capillary structure, a housing into which the cartridge can be removably inserted, the housing being adapted for use in a predetermined orientation and, when so oriented, being arranged to locate the cartridge with the capillary structure extending generally vertically upwards, and high voltage means located within the housing exteriorly of the cartridge for applying electrostatic potential to the liquid within the cartridge, the housing including a cover having an aperture through which the tip of the capillary structure projects or is arranged to spray and the cover comprising at least in the region surrounding said aperture a semi-insulating material and means located beneath the external surface of the cover for providing an electrically conductive path for transporting electrical charge away from the cover.

17. A device as claimed in claim 1 in which the means for leaking charge away from the cover comprises an electrode embedded within the material of the cover.

18. A device as claimed in claim 14 or 16 in which the capillary structure is such that:

when oriented substantially vertically with the spraying outlet disposed upwards, the capillary action is sufficient; independently of the electrostatic forces prevailing in use, to transport liquid upwardly against the action of gravity to the spraying outlet of the capillary structure:

and the spraying outlet comprising:

an innermost peripheral surface bounding a mouth of the spraying outlet, an outermost peripheral surface and an end surface extending laterally between said peripheral surfaces such that, when the liquid at the mouth of the spraying outlet is subjected to at last one potential within the range from 10 kV to 25 kV, a potential gradient is developed between said peripheral surfaces which is sufficient to draw the liquid across said end face towards said outermost peripheral surface whereby, at a position or positions located outwardly of said innermost surface the liquid is projected electrostatically as an array of ligaments which form a halo around the mouth of the spraying outlet and thereafter break up into droplets.

19. A device as claimed in claim 14 or 16 in which said end surface is generally planar and perpendicular to an axis of elongation of the capillary structure.

20. A device as claimed in claim 14 or 16 wherein the cartridge comprises a bottom wall formed with a recess, the capillary structure extending into the interior of the cartridge with one end of the capillary structure received in said recess so as to feed liquid by capillary action from the recess to a spraying outlet at the tip of the capillary structure, and means for providing an electrically conductive path to allow application of an electrostatic charge directly to a portion of liquid accommodated within the recess.

21. A device as claimed in claim 20, wherein the cartridge has a squat configuration with a vertical dimension less than its horizontal dimension.

22. A device as claimed in claim 21 in which the cartridge is so designed that the difference in liquid level between the full and near empty conditions of the cartridge does not change by more than 15 millimeters.

23. A device as claimed in claim 14 or 16, further comprising a housing into which the cartridge can be removably inserted, the housing being adapted for use in a predetermined orientation and, when so oriented, being arranged to locate the cartridge with the capillary structure extending generally vertically upwards, and high voltage means located within the housing exteriorly of the cartridge for applying electrostatic potential to said means providing an electrically conductive path to the liquid with the cartridge.

24. A device as claimed in claim 23 in which the high voltage means is by-polar whereby successive clouds of sprayed particles are of opposite polarity.

* * * * *